United States Patent [19]

Mattarelli

[11] Patent Number: 4,718,186

[45] Date of Patent: Jan. 12, 1988

[54] PIVOTAL CONNECTION BETWEEN BREAK-OPEN ACTION AND BARREL OF A GUN

[75] Inventor: Ennio Mattarelli, Zola Predosa, Italy

[73] Assignee: Dynamit Nobel AG, Fed. Rep. of Germany

[21] Appl. No.: 844,121

[22] Filed: Mar. 26, 1986

[30] Foreign Application Priority Data

Mar. 26, 1985 [IT] Italy ..... 4829/85[U]

[51] Int. Cl.[4] ..... F41C 11/08

[52] U.S. Cl. ..... 42/75.04; 42/40

[58] Field of Search ..... 42/40, 44, 75.04, 8, 42/12, 26

[56] References Cited

U.S. PATENT DOCUMENTS

| | | | |
|---|---|---|---|
| 804,349 | 11/1905 | Stendebach | 42/40 |
| 926,456 | 6/1909 | Behr | 42/40 |
| 1,004,269 | 9/1911 | Jäger | 42/40 |
| 3,766,677 | 10/1973 | Waddell | 42/40 |
| 4,199,886 | 4/1980 | Deuring | 42/40 X |

FOREIGN PATENT DOCUMENTS

| | | | |
|---|---|---|---|
| 16409 | 5/1904 | Austria | 42/40 |
| 193760 | 9/1906 | Fed. Rep. of Germany . | |
| 378765 | 7/1923 | Fed. Rep. of Germany . | |

*Primary Examiner*—Ted L. Parr

*Attorney, Agent, or Firm*—Antonelli, Terry & Wands

[57] ABSTRACT

Articulated connection between the break-open action and the at least one barrel of a rifle with two coaxial pairs of articulation members, the two articulation members (1*a* and 2*a*) of each pair complementing each other, and respectively one articulation member being provided at the break-open action (1) and, respectively, at the corresponding sidewall of the barrel (20). These articulation members (1*a* and 2*a*) exhibit a coupling profile (P1 and P2, respectively) ensuring a shape-mating connection between the break-open action (1) and the barrel (20) also transversely to the firing direction, this coupling profile permitting utilization of the axial pressure (S) produced during firing for generating a component force that is perpendicular to the aforementioned axial pressure (S) and counteracts the spreading apart of the sidewalls (1*b*) of the break-open action (1).

10 Claims, 3 Drawing Figures

Figures 1, 2, 3:
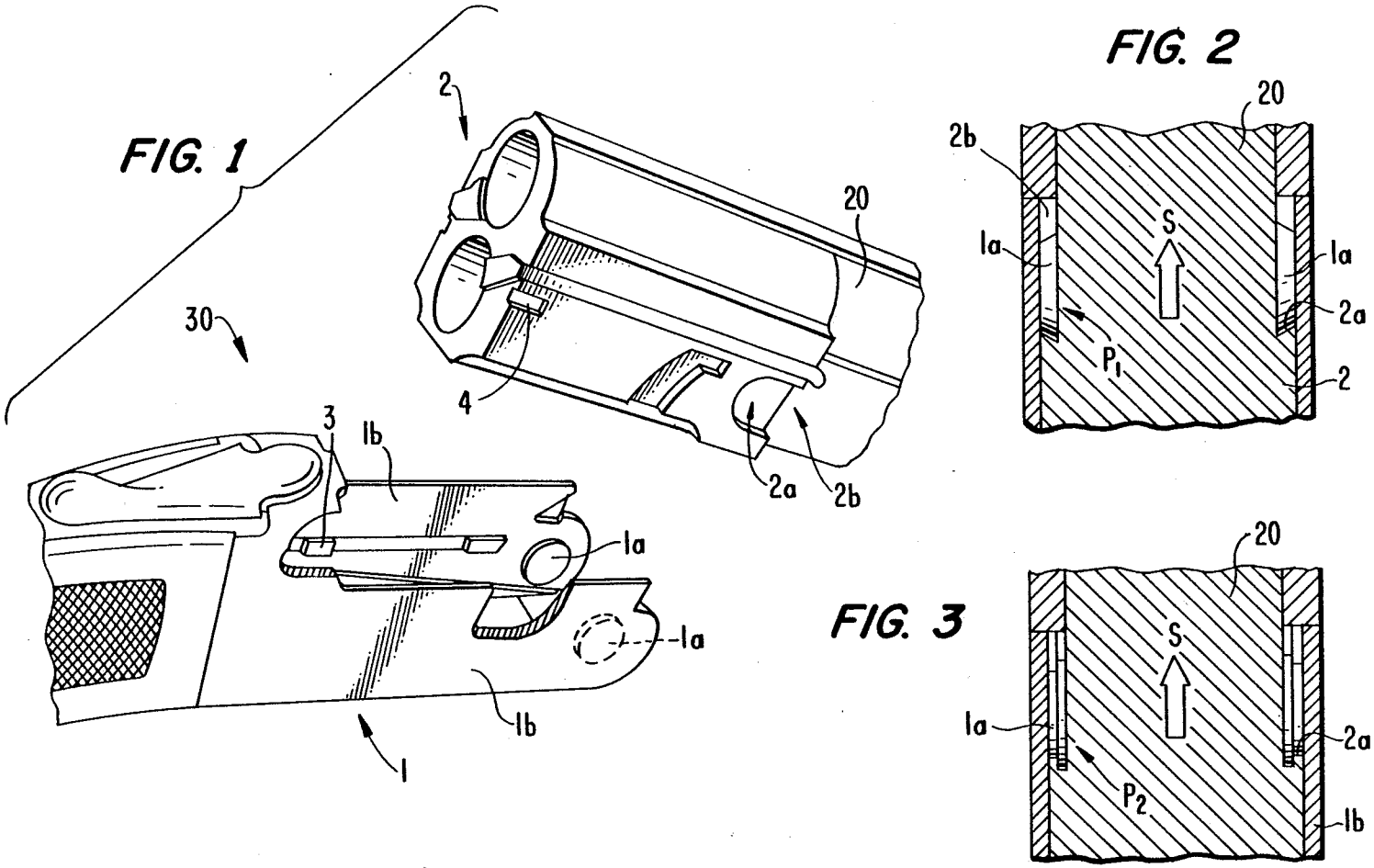

20
1a
2a
2
S
P1
2b
P2
1b
30
3
4
1

PIVOTAL CONNECTION BETWEEN BREAK-OPEN ACTION AND BARREL OF A GUN

The present invention concerns the field of art of firearms, especially shotguns (rifles) with manual feeding of cartridges into a barrel or also into two superimposed barrels.

As is known, the lock mechanisms are initiated based on the movement of the barrels about a fulcrum lying in the proximity of the forward portion of the break-open action. Such a tilting of the barrels furthermore permits release of the rearward portion of the barrel or of both barrels in order to introduce the cartridges.

The articulated or pivotal connection, however, also is to be designed so that the break-open action and the barrels can readily be coupled together and decoupled from each other. One disadvantage of the conventional solutions in this respect resides in that certain clearances are produced between the articulation members at the barrel and those of the break-open action after a longer-term use of the rifle. Besides, an axial pressure is exerted on the barrels during firing, accelerating the wear and tear on the aforementioned articulation or pivotal members.

Attempts have been made to provide a remedy by inserting in the break-open action additional locking mechanisms (hooks and pins) thereby to diminish the stresses exerted on the aforementioned articulation members. However, due to the differing distribution of wear and tear on the connection components and the additional locking mechanisms, these devices suffer increasing loss of effectiveness as time goes by.

Besides, the axial pressure generated during firing of a shot causes a component force, on account of which a bending moment is produced that acts on the sidewalls of the break-open action and has a tendency toward opening up to the outside.

Therefore, the present invention is based on the object of providing an articulated connection wherein a component force is produced during the firing process, this force generating a bending moment closing the sidewalls of the break-open action toward the inside whereby the occurrence of clearances is delayed.

This object has been attained by means of an articulated connection provided between a break-open action and the gun barrels, characterized in that this connection comprises two coaxial pairs of articulation members, the articulation members of each pair supplementing each other and being formed at the aforementioned break-open action and, respectively, at the corresponding sidewall of the barrel or barrels, and exhibiting a mutually fitting coupling profile so that the axial pressure generated during firing produces a component force perpendicular to this axial pressure, this component force counteracting the bending moment causing the spreading apart of the two sidewalls of the break-open action.

Further advantageous embodiments are indicated in the dependent claims.

The invention is illustrated in the drawing by embodiments and will be described below with reference thereto. In the drawing:

FIG. 1 shows a perspective view of a first embodiment of articulation members at the break-open action and at the rifle barrels, FIG. 2 shows schematically a horizontal sectional view of the attachment zone of barrel and break-open action according to FIG. 1, and FIG. 3 is a modification of FIG. 2.

In FIG. 1, reference numeral 1*a* indicates the articulation male members or projections at the sidewalls 1*b* of the break-open action 1, and reference numeral 2*a* denotes the complementary articulation female members or recesses arranged at the sidewall 2 formed integrally with the barrels 20 of a gun 30. The articulation members 1*a* are arranged herein on the inside in the forward zone of the sidewalls 1*b* facing the barrels 20 and are manufactured integrally therewith or, in case of separate manufacture, are joined thereto subsequently, for example by welding, soldering, cementing, or the like.

Reference numeral 2*b* signifies the opening zone of the articulation member 2*a*, permitting the insertion and/or removal of the aforementioned barrels 20 in or out of the break-open action 1.

The articulation members 1*a* and 2*a* are of such a structure that they provide not only the customary connection in the longitudinal or axial direction of the break-open action or barrels, but additionally also a shape-mating or close fitting locking action between the sidewalls 1*b* and the barrels 20 transversely to the firing direction, as shown in greater detail in FIGS. 2 and 3.

The barrels 20 are locked in the ready for firing position to the break-open action 1 by means of interlocking elements 3 arranged at the sidewalls 1*b* of the break-open action and being fashioned so that they engage into the cutouts 4 provided in the sidewalls of the barrels.

The profile P1 of the articulation members 1*a* shown in projection in FIG. 2 exhibits, in this first embodiment, the shape of a truncated cone, the smaller end face of which faces the sidewalls 1*b*.

The profile P2 of the embodiment according to FIG. 3, likewise shown in projection, exhibits a T-shape in that the articulation member 1*a* is fashioned as a stepped circular cylinder arranged so that it faces the sidewalls 1*b* with its area that is smaller in diameter, the small face of this cylinder being located on the aforementioned sidewall 1*b* of the break-open action 1.

The articulation members 2*a* arranged on the outside of the sidewall 2 complement the profiles Pl and P2 of the articulation members 1*a* in that they are formed with corresponding, undercut portions, making it possible for the articulation members 1*a* to "hook together" with them (shape-mating coupling) not only in the axial direction but also perpendicularly thereto, i.e. transversely to the firing direction in the horizontal direction.

The force acting on the barrels 20 in the axial direction, evolving due to gas pressure during firing, causes shear stress on the articulation members 1*a*, to which is furthermore added the bending moment which acts on the sidewalls 1*b*, likewise caused by the gas pressure.

The configuration of the profiles P1 and P2 provided by this invention ensures that this bending moment is counteracted, which bending moment would otherwise spread the sidewalls 1*b* apart; this is accomplished by producing reaction moments by the aforementioned "hooking together" of the articulation members 1*a* and 2*a* which tend to pull the sidewalls 1*b* inwardly, these reaction moments being at least equivalent to the bending moment.

The resultant advantages reside in elimination of the stresses acting on the walls 1*a* of the break-open action and consequently in reducing the wear and tear on the articulation members 1*a* and 2*a* caused by these stresses.

All of this means greater reliability and precision of the gun 30 as compared with the conventional systems, even after a long-term usage of the gun.

The invention, of course, has been described by way of example without limiting same, so that possible changes in construction of the components are included in the scope of the technical solution described hereinabove and claimed hereinbelow.

I claim:

1. A pivotal connection between the sidewalls of a break-open action and at least one barrel of a gun, said connection comprising two coaxial pairs of pivotal members arranged on a common pivot axis, a center of one member of each pair defining said common pivot axis, the two pivotal members of each pair being arranged to complement each other, with one member being provided on a sidewall of the break-open action of the gun and the other member being provided on a corresponding sidewall of the at least one barrel, and said members of each pair exhibiting coupling profiles ensuring a shape-mating connection between the break-open action and the barrel transversely of the axis of the barrel of the gun, said coupling profiles permitting utilization of the axial pressure (S) generated during firing for producing a component force perpendicular to the axial pressure (S), counteracting the spreading apart of the sidewalls of the break-open action.

2. The connection according to claim 1, wherein the member on the sidewall of the break-open action comprises a projection having a profile in the shape of a truncated cone, a smaller face of which faces an inside surface of the associated side wall of the break-open action.

3. The connection according to claim 2, wherein the member on the sidewall of the at least one barrel comprises a recess having a profile with an undercut portion that complements the cone-shape of the projection to provide a shape-mating connection therebetween.

4. The connection according to claim 1, wherein the member on the break-open action comprises a projection exhibiting a T-shaped configuration the smaller area of which is associated with the inside of the associated sidewall of the break-open action.

5. The connection according to claim 4, wherein the member on the sidewall of the at least one barrel comprises a recess having a profile with an undercut portion that complements the T-shaped configuration of the projection to provide a shape-mating connection therebetween.

6. A pivotal connection between the sidewalls of a break-open action and at least one barrel of a gun, said connection comprising two pairs of pivotal members arranged on a common pivot axis, a center of one member of each pair defining said common pivot axis, one member of each pair being a projection provided on a sidewall of the break-open action of the gun and the other member of each pair being a recess provided on a corresponding sidewall of the at least one barrel, said projection and said recess exhibiting profiles which provide a hook like connection between said members, the hook like connection provided by each of said pair of pivotal members causing the axial pressure generated during firing of the weapon to produce a component force perpendicular to the axial pressure which counteracts spreading apart of the sidewalls of a break-open action.

7. The connection according to claim 6, wherein the projection on each sidewall of the break-open action has a profile in the shape of a truncated cone, a smaller face of which faces an inside surface of the associated side wall of the break-open action.

8. The connection according to claim 7, wherein the recess on the sidewall of the at least one barrel has a profile with an undercut portion that complements the cone-shape of the projection to provide a shapemating connection therebetween.

9. The connection according to claim 6, wherein the projection on each sidewall of the break-open action has a profile exhibiting a T-shaped configuration, the smaller area of which is associated with the inside of the associated sidewall of the break-open action.

10. The connection according to claim 8, wherein the recess on the sidewall of the at least one barrel has a profile with an undercut portion that complements the T-shaped configuration of the projection to provide a shape-mating connection therebetween.

* * * * *